US007559355B2

(12) United States Patent
Oh

(10) Patent No.: US 7,559,355 B2
(45) Date of Patent: Jul. 14, 2009

(54) TUBE FOR HEAT EXCHANGER

(75) Inventor: Kwangheon Oh, Daejeon-si (KR)

(73) Assignee: Halla Climate Control Corporation, Daejeon-si (KR)

( * ) Notice: Subject to any disclaimer, the term of this patent is extended or adjusted under 35 U.S.C. 154(b) by 234 days.

(21) Appl. No.: 10/559,038

(22) PCT Filed: Jun. 21, 2004

(86) PCT No.: PCT/KR2004/001484

§ 371 (c)(1),
(2), (4) Date: Nov. 30, 2005

(87) PCT Pub. No.: WO2004/113817

PCT Pub. Date: Dec. 29, 2004

(65) Prior Publication Data

US 2006/0118288 A1 Jun. 8, 2006

(30) Foreign Application Priority Data

Jun. 20, 2003 (KR) ..... 10-2003-0040076
Jun. 21, 2004 (KR) ..... 10-2004-0045919

(51) Int. Cl.
*F28F 1/40* (2006.01)

(52) U.S. Cl. ..... 165/177; 138/115

(58) Field of Classification Search ..... 165/177, 165/164; 138/115; 29/890.053
See application file for complete search history.

(56) References Cited

U.S. PATENT DOCUMENTS 1,501,646 A * 7/1924 Brown ..... 165/177
1,502,301 A * 7/1924 Fedders ..... 165/151
1,780,110 A * 10/1930 Bliss ..... 165/134.1
1,922,838 A * 8/1933 Bossart ..... 165/177
3,964,873 A * 6/1976 Aramaki et al. ..... 165/177
3,970,113 A * 7/1976 Guttinger et al. ..... 138/171
4,014,962 A * 3/1977 del Notario ..... 165/177
4,819,586 A * 4/1989 Kreuter ..... 165/177
5,590,708 A * 1/1997 Ulrich ..... 165/165
5,839,505 A * 11/1998 Ludwig et al. ..... 165/177
6,192,978 B1 2/2001 Guzowski et al.
6,357,522 B2 * 3/2002 Dienhart et al. ..... 165/177
6,854,512 B2 * 2/2005 Lee et al. ..... 165/177

FOREIGN PATENT DOCUMENTS

JP 62-33288 A 2/1987
JP 11-44498 A 2/1999
JP 11-159985 A 6/1999

* cited by examiner

*Primary Examiner*—Leonard R Leo
(74) *Attorney, Agent, or Firm*—Fulbright & Jaworski L.L.P.

(57) ABSTRACT

The present invention relates to a heat exchanger tube, in which turbulence generating portions placed within a passage of the tube are rounded into curved configurations with predetermined curvatures so that they are hardly damaged or fractured during extrusion to improve machinability and product quality, in which upper and lower circular passages formed in upper and lower sides of a tube body are connected via a connecting passage having the turbulence generating portions so that more passages having a smaller hydraulic diameter can be formed in the tube of the same size without unnecessary waste of tube material, and in which the turbulence generating portions are arranged in a lateral direction (Z-axial direction) of the tube body so that the passage is not filled with condensate films even though a large quantity of condensate is produced to reduce the thickness of the condensate films or break the condensate films to promote refrigerant to be converted into turbulent flow, thereby improving heat transfer ability.

3 Claims, 8 Drawing Sheets

TUBE FOR HEAT EXCHANGER

This is a 371 of PCT/KR2004/001484 filed Jun. 21, 2004, which claims priority from Korean Patent Application No. 10- 2003- 0040076 filed Jun. 20, 2003 and Korean Patent Application No. 10- 2004- 0045919 filed Jun. 21, 2004.

TECHNICAL FIELD

The present invention relates to a heat exchanger tube, more particularly, in which turbulence generating portions placed within a passage of the tube are rounded into curved configurations with predetermined curvatures so that they are hardly damaged or fractured during extrusion to improve machinability and product quality, in which upper and lower circular passages formed in upper and lower sides of a tube body are connected via a connecting passage having the turbulence generating portions so that more passages having a smaller hydraulic diameter can be formed in the tube of the same size without unnecessary waste of tube material, and in which the turbulence generating portions are arranged in a lateral direction (Z-axial direction) of the tube body so that the passage is not filled with condensate films even though a large quantity of condensate is produced to reduce the thickness of the condensate films or break the condensate films to promote refrigerant to be converted into turbulent flow, thereby improving heat transfer ability.

BACKGROUND ART

Examples of heat exchangers of an automobile air conditioning system generally include a condenser which heat exchanges high temperature and pressure refrigerant with the ambient air to convert refrigerant into liquid state and an evaporator which transforms liquid refrigerant into low temperature gaseous phase to cool the indoor air.

Each of the condenser and the evaporator includes tubes having refrigerant passages through which refrigerant flows, corrugated heat radiating fins interposed between the tubes, header tanks connected with both ends of the tubes in a communicating fashion and inlet and outlet pipes installed in the header tanks for allowing refrigerant to flow into/out of the header tanks.

As an example of such a heat exchanger, the condenser adopts a flat tube having multiple passages as disclosed in Japanese Patent Publication No. 1999-159985.

Since the tube passages disclosed in the above document are elongated in a lateral direction of the tubes, in the event of reducing diameter to increase the number of passages, the thickness of upper and lower walls is increased thereby unnecessarily enlarging mass. Further, in case of reducing the hydraulic diameter of the passages in order to raise heat exchange efficiency in the tube of the same size, the thickness of the outside wall of the tube is unnecessarily increases.

In the prior art, passage junctions of the tube are provided in upper and lower sides of the tube passages so that an excessive quantity of condensate within a passage may fill a lower portion of the passage to degrade the effect of breaking a condensate film thereby deteriorating overall heat transfer performance.

Furthermore, a sharp leading end is formed in the passage of the tube, the leading end may be easily fractured or poorly shaped owing to the shape of a tool and limited endurance, thereby degrading productivity and product quality.

DISCLOSURE OF THE INVENTION

The present invention has been made to solve the foregoing problems and it is therefore an object of the present invention to provide a heat exchanger tube, in which turbulence generating portions placed within a passage of the tube are rounded into curved configurations with predetermined curvatures so that they are hardly damaged or fractured during extrusion to improve machinability and product quality, in which upper and lower circular passages formed in upper and lower sides of a tube body are connected via a connecting passage having the turbulence generating portions so that more passages having a smaller hydraulic diameter can be formed in the tube of the same size without unnecessary waste of tube material, and in which the turbulence generating portions are arranged in a lateral direction (Z-axial direction) of the tube body so that the passage is not filled with condensate films even though a large quantity of condensate is produced to reduce the thickness of the condensate films or break the condensate films to promote refrigerant to be converted into turbulent flow, thereby improving heat transfer ability.

According to an aspect of the invention for realizing the above objects, there is provided a heat exchanger tube comprising: a flat body having predetermined lengths in longitudinal, vertical and lateral directions, respectively; and a number of refrigerant passages formed through the body in the longitudinal direction and arranged in plurality in the lateral direction, wherein each of the refrigerant passages comprises: upper and lower circular passages formed in upper and lower sides of the body in the vertical direction with predetermined radii R1 and R2, respectively; a connecting passage for connecting the upper and lower circular passages in a communicating fashion; and turbulence generating portions projected from laterally opposed inside wall portions of the connecting passage with predetermined radii of curvature R3 and R4, respectively.

BEST MODE FOR CARRYING OUT THE INVENTION

Hereinafter preferred embodiments of a heat exchanger tube according to the present invention will be described in detail with reference to the accompanying drawings.

Figure 1:
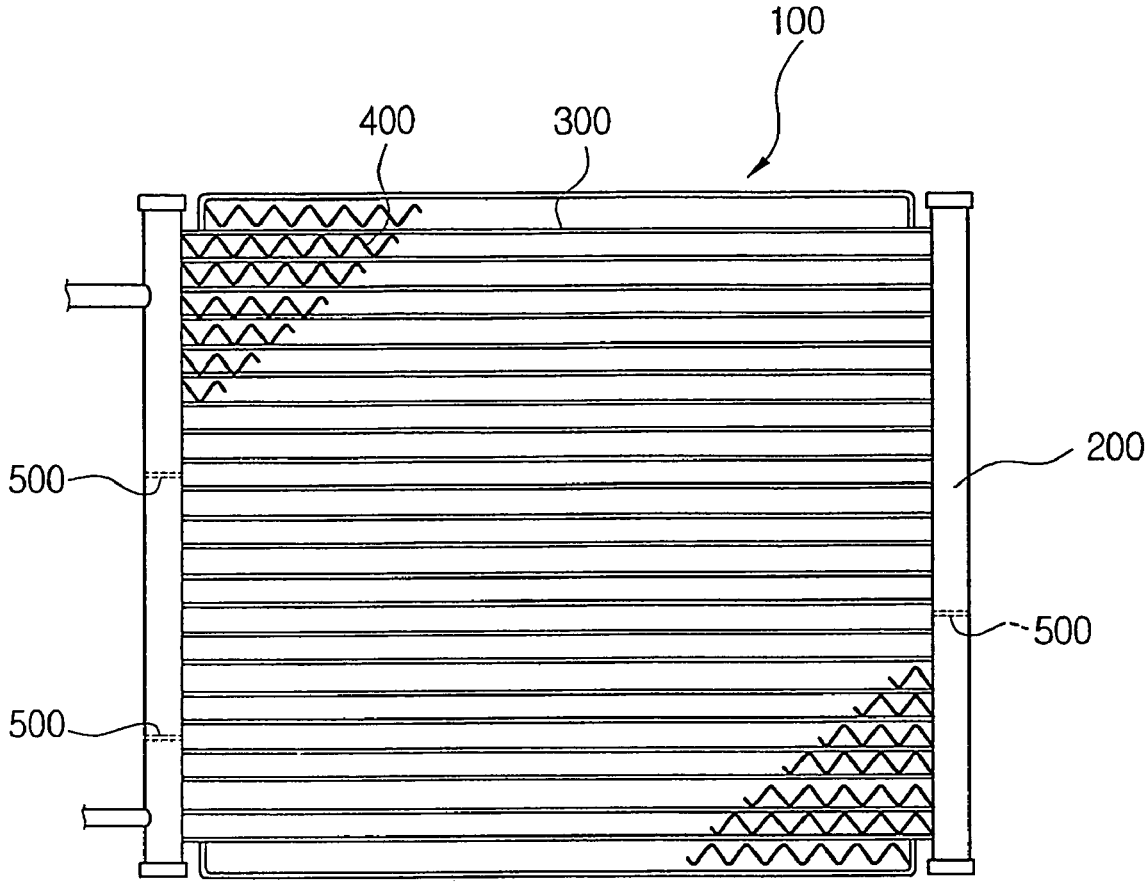
FIG. 1 is a front elevation view illustrating a condenser of a heat exchanger which adopts a heat exchanger tube of the present invention.
Figure 2:
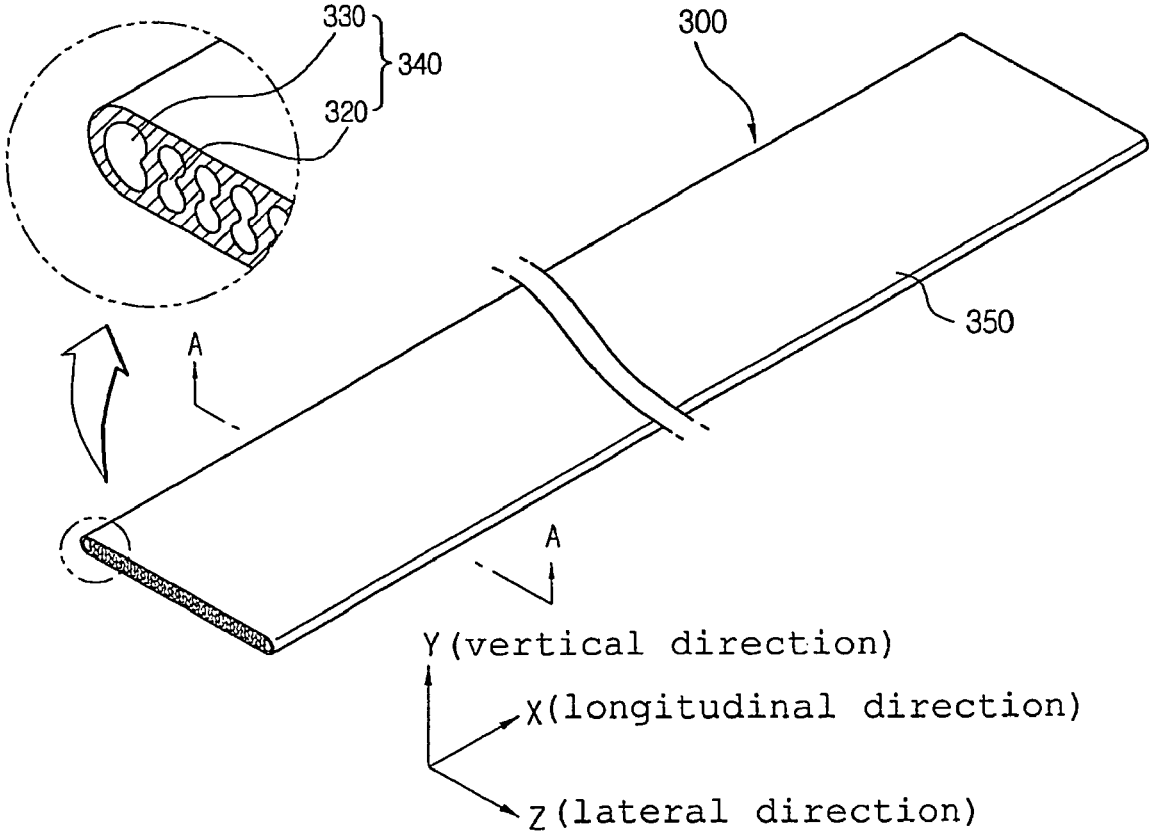
FIG. 2 is a perspective view illustrating a heat exchanger tube according to an embodiment of the present invention.
Figure 3:
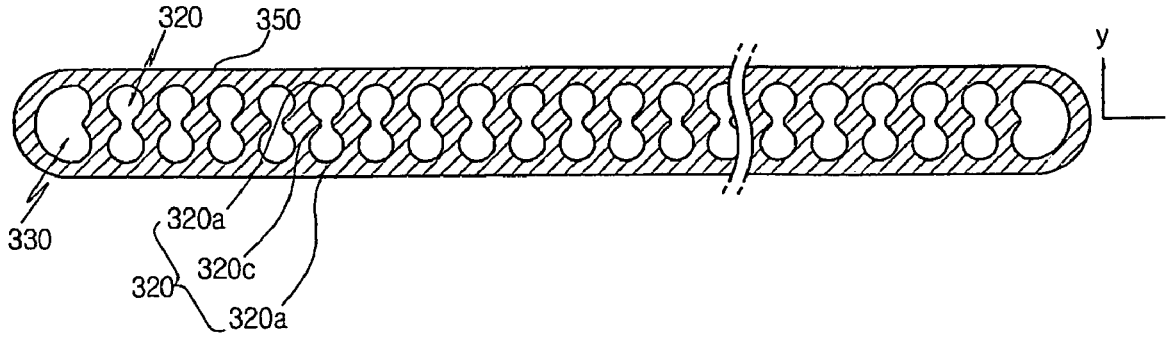
FIG. 3 is a sectional view taken along A-A line in FIG. 2.
Figure 4:
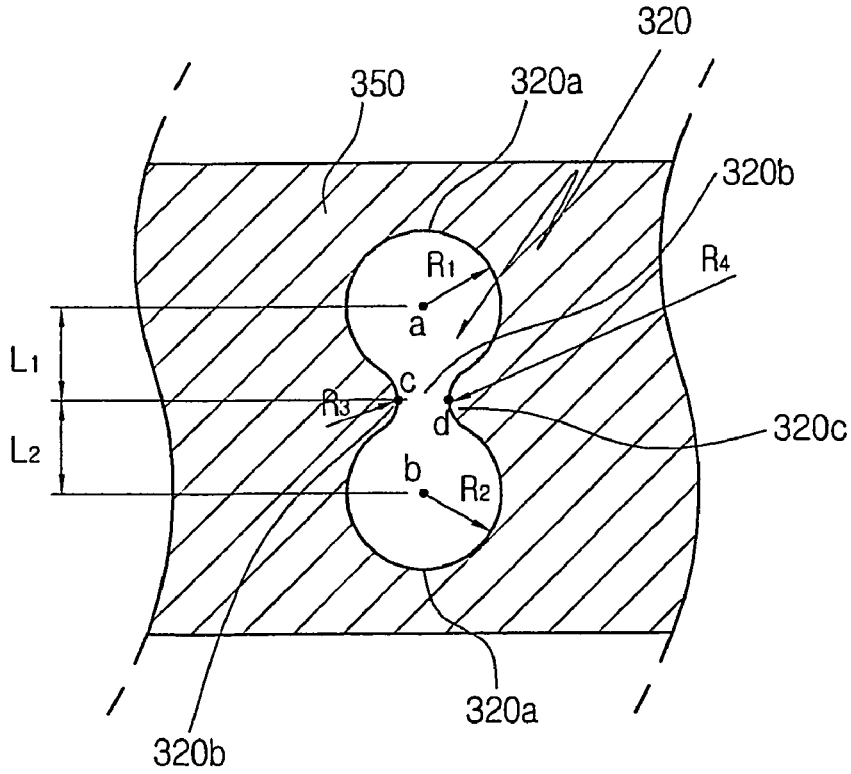
FIG. 4 is an enlarged sectional view illustrating a part of the heat exchanger tube shown in FIG. 3.
Figure 5:
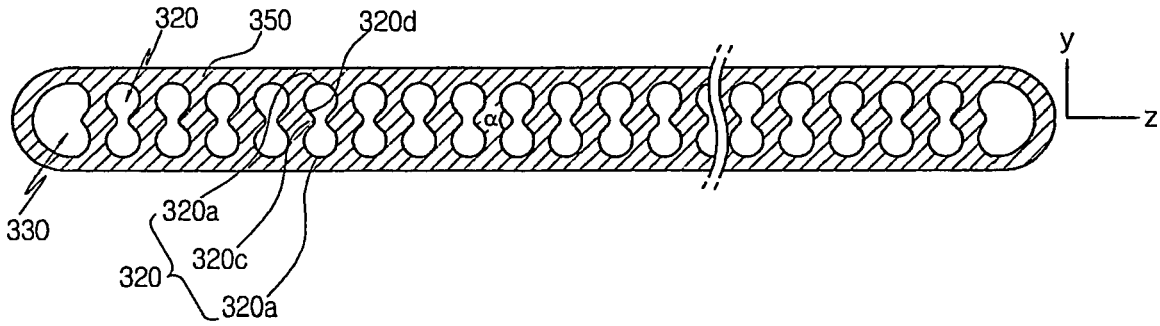
FIG. 5 is a sectional view illustrating heat exchanger tube according to an alternative embodiment of the present invention.
Figure 6:
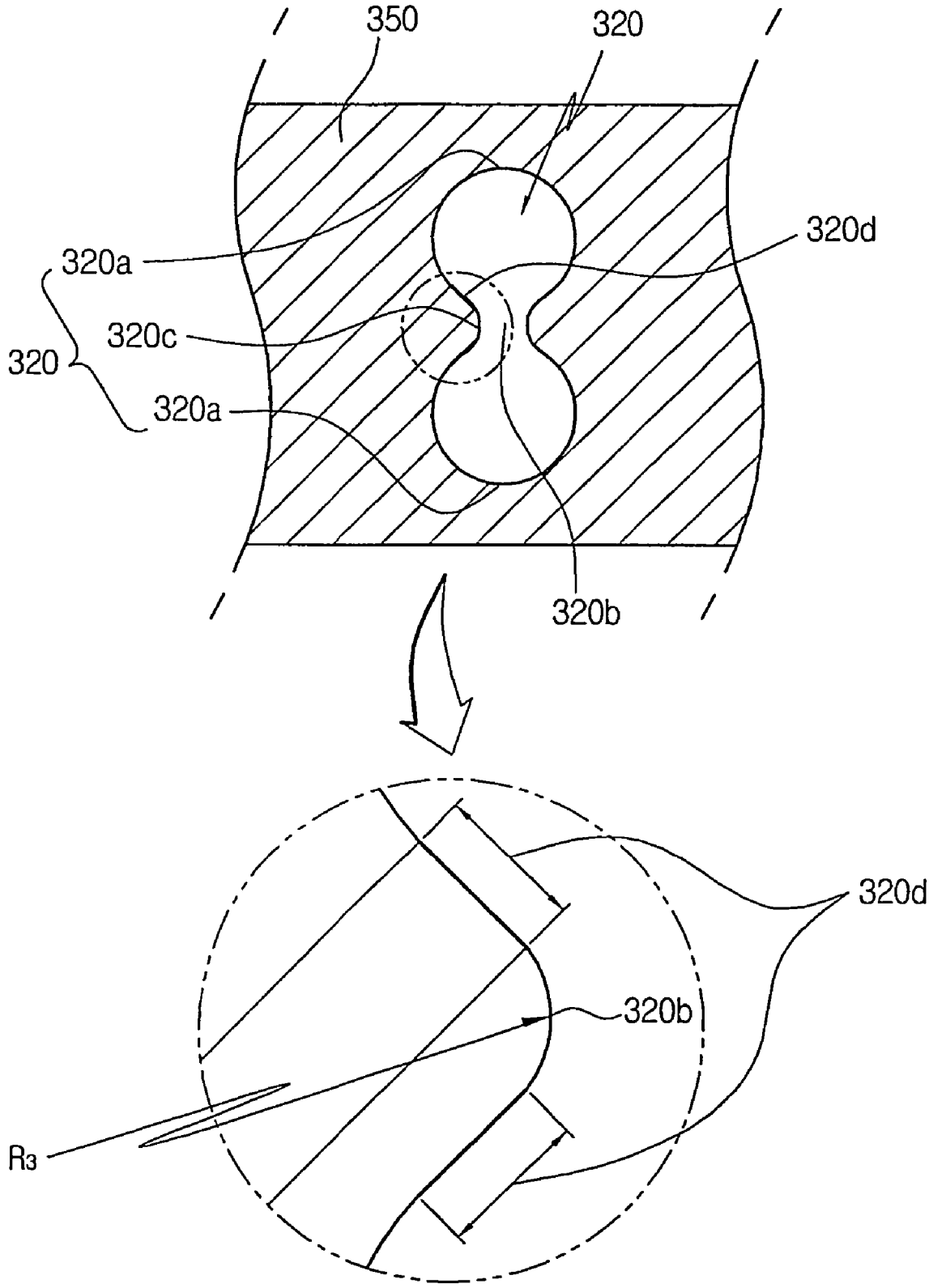
FIG. 6 is an enlarged sectional view illustrating a part of the heat exchanger tube shown in FIG. 5.
Figure 7:
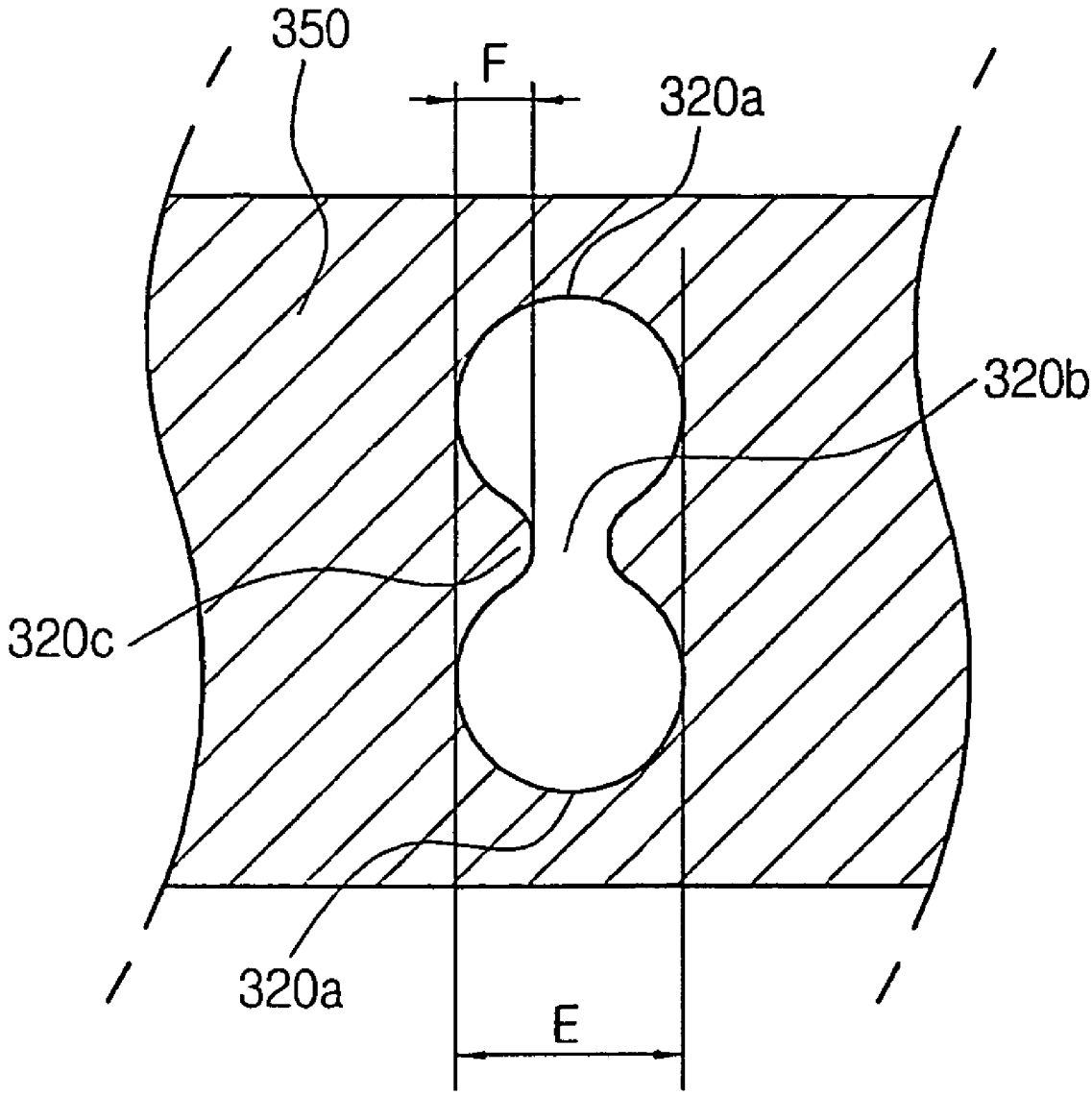
FIG. 7 is a sectional view illustrating the projected ratio of a turbulence generating portion in the heat exchanger tube of the present invention.
Figure 8:
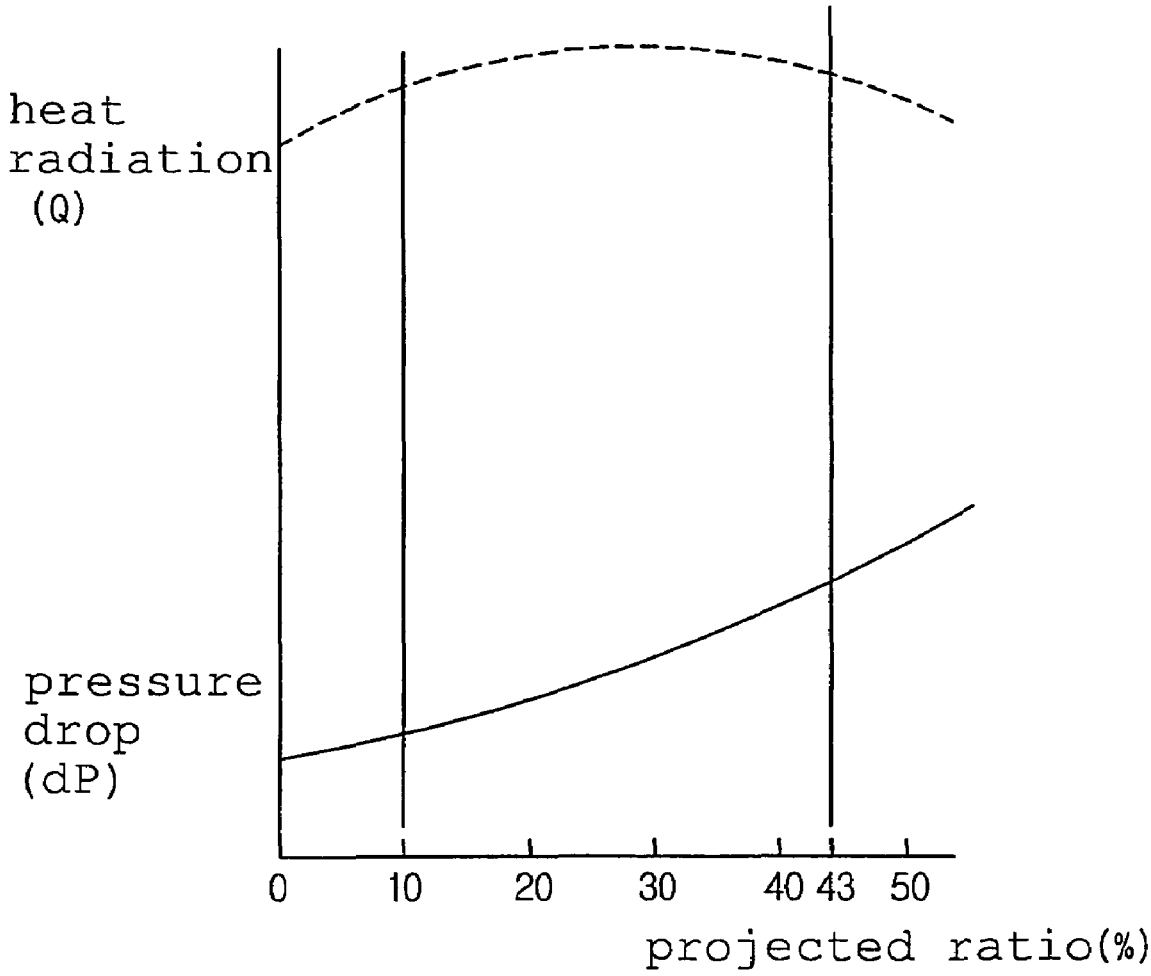
FIG. 8 is a graph illustrating the variation of heat radiation and pressure drop according to the projected ratio of the turbulence generating portion in the heat exchanger tube of the present invention.
Figure 9:
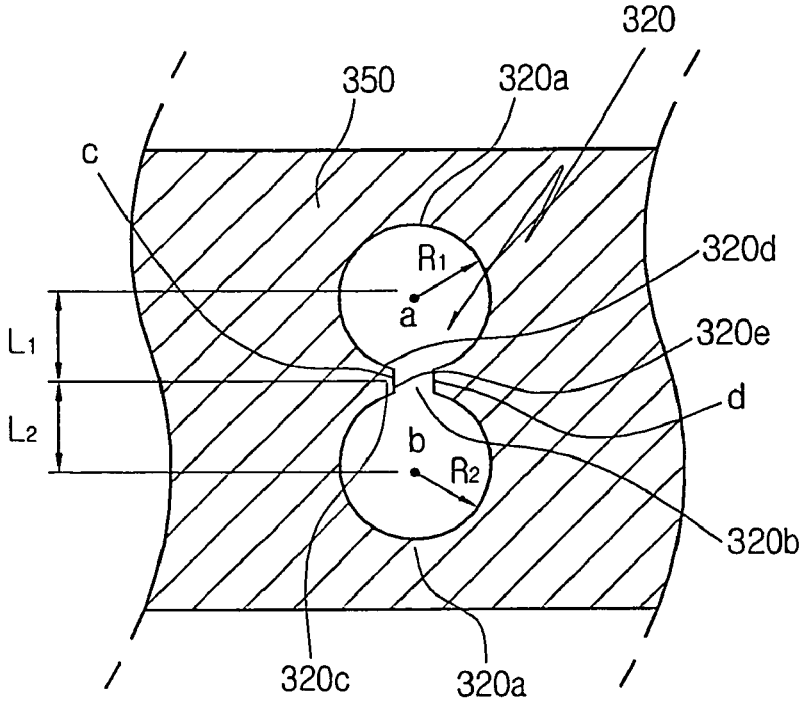
FIG. 9 is an enlarged sectional view illustrating a heat exchanger tube according to another alternative embodiment of the present invention.
Figure 10:
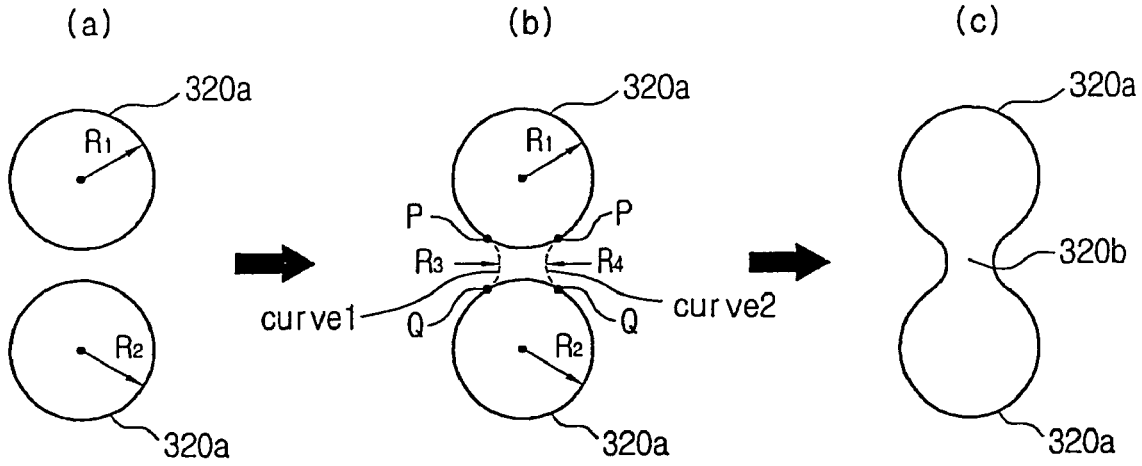
FIG. 10 illustrates a process of forming an inside passage according to the present invention.

FIG. 1 is a front elevation view illustrating a condenser of a heat exchanger which adopts a heat exchanger tube of the present invention, FIG. 2 is a perspective view illustrating a heat exchanger tube according to an embodiment of the present invention, FIG. 3 is a sectional view taken along A-A line in FIG. 2, FIG. 4 is an enlarged sectional view illustrating a part of the heat exchanger tube shown in FIG. 3, FIG. 5 is a sectional view illustrating heat exchanger tube according to an alternative embodiment of the present invention, FIG. 6 is an enlarged sectional view illustrating a part of the heat exchanger tube shown in FIG. 5, FIG. 7 is a sectional view illustrating the projected ratio of a turbulence generating portion in the heat exchanger tube of the present invention, FIG. 8 is a graph illustrating the variation of heat radiation and pressure drop according to the projected ratio of the turbulence generating portion in the heat exchanger tube of the present invention, FIG. 9 is an enlarged sectional view illustrating a heat exchanger tube according to another alternative embodiment of the present invention, and FIG. 10 illustrates a process of forming an inside passage according to the present invention.

First, prior to the description of a heat exchanger tube structure realized by the invention, a brief discussion will be made about a condenser as an example of a heat exchanger to which the present invention is applied.

As shown in FIG. 1, a condenser 100 includes a pair of header tanks 200 each having a passage for allowing the passage of heat exchange medium (or refrigerant), a number of tubes 300 forming spaces through which heat exchange medium flows and a number of heat radiating fins 400 each interposed between two adjacent ones of the tubes 300.

Both ends of each of the tubes 300 are connected to the header tanks 200 in a communicating fashion. Inside each of the header tanks 200 connected with the tubes 300, at least one baffle is provided to form a plurality of flow passages defined by the number of the tubes 300.

The present invention relates to this tube 300, which comprises a flat body 350 having specific lengths in longitudinal (X-axial), vertical (Y-axial) and lateral (Z-axial) directions as shown in FIGS. 2 and 3.

The body 350 has a plurality of refrigerant passages 340 formed through the body 350 along the longitudinal (X-axial) direction thereof, in which the refrigerant passages 340 consist of outer passages 330 which are provided at both outermost sides of the body 350, respectively, and a plurality of inner passages 320 which are provided between the two outer passages 330.

As shown in FIG. 4, each of the inner passages 320 of the refrigerant passages 340 includes upper and lower circular passages 320*a*, which are formed in upper and lower sides in the vertical (Y-axial) direction with specific radii R1 and R2, respectively, a connecting passage 320*b* for connecting a lower portion of the upper one of the circular passages 320*a* with an upper portion of the lower one of the circular passages 320*a* in a communicating fashion and turbulence generating portions 320*c* which are projected from laterally opposed inside wall portions of the connecting passage 320*b* and have specific radii of curvature R3 and R4, respectively. Each of the outer passages 330 is shaped substantially the same as or similar to the circumferential surface of adjacent one of the inner passages 320 and the outer configuration of the tube 350.

A process of forming the inner passages will be described with reference to FIG. 10 as follows: First, as shown in FIG. 10(*a*), upper and lower circular passages 320*a* are drawn with respective radii R1 and R2.

Next, as shown in FIG. 10(*b*), curves 1 and 2 with respective radii of curvature R3 and R4 are drawn between the circular passages 320*a* to define a connection passage 320*b*.

Then, as shown in FIG. 10(*c*), curve 1 and curve 2 with respective radii of curvature R3 and R4 are connected at intersections 'P' and 'Q' with the upper and lower circular passages 320*a*, respectively, to form a closed curve thereby defining the entire contour of an inner passage 320 having the connection passage.

Herein magnitude of the radii R1 to R4 may be selectively determined.

Then, if turbulence generating portions 320*c* are rounded with the specific radii of curvature R3 and R4, they are rarely damaged when extruded so that machinability may be elevated thereby improving the quality of products.

With the present invention, in case that the outer passages 330 are provided with projections corresponding to the turbulence generating portions, the projections are also preferably rounded with specific radii of curvature in order to prevent damage associated with extrusion.

Further, because the turbulence generating portions 320*c* formed in the lateral (Z-axial) direction, the heat exchanger tube of the present invention can reduce dead zones that are created at corners from the surface tension of refrigerant. Also, even though a large quantity of condensate is produced, the passage of the heat exchanger tube of the present invention is not filled with condensate films so that the condensate films can be effectively broken.

Each of the inner passages of the invention consists of the upper and lower circular passages and the connecting passage for connecting the upper and lower circular passages, and thus is elongated in the vertical direction compared to the lateral direction of the tube body. As a result, more passages can be formed in a tube of the same size without unnecessarily wasting tube material.

That is, this can increase the number of the refrigerant passages 320 while reducing hydraulic diameter, thereby uniformly maintaining the thickness of the tube wall.

This also can reduce the weight and manufacture cost of the tube, and the turbulence generating portions 320*c* projected in the lateral (Z-axial) direction of the refrigerant passage 320 can reduce the thickness of the condensate films or break the same to promote refrigerant to be converted into turbulent flow, thereby improving heat transfer ability.

As shown in FIGS. 5 and 6, the connecting passage may further include predetermined length of linear sections 320*d* in connecting sections for connecting the turbulence generating portions 320*c* with the upper and lower circular passages 320*a*.

When the curved turbulence generating portions are connected with the upper and lower circular passages via the linear sections to have predetermined radii of curvature, there is an advantage that the radius of curvature and the size of the turbulence generating portions can be selected freely.

In the present invention having the above structure, it is most preferable that the projected ratio of the turbulence generating portions 320*c* is determined from 0.1 to 0.43 as shown in FIG. 7.

the projected ratio is obtained by dividing the projected length 'F' of the turbulence generating portions which is a distance between an outer common tangential line of the upper and lower circular passages and a tangential line of the turbulence generating portions parallel to the outer common tangential line with the maximum value 'E' of diameters of the upper and lower circular passages as expressed in an equation of F/E.

According to the present invention, if the tube size is the same and the number of refrigerant passages within the tube is the same, heat radiation performance and refrigerant pressure drop are varied according to the projected ratio of the turbulence generating portions 320*c*.

As a consequence, it is necessary to set the projected ratio within a suitable range in order to satisfy heat radiation performance and refrigerant pressure drop at the same time.

FIG. 8 illustrates the variation of refrigerant pressure drop dP and heat radiation quantity Q according to the projected ratio of the turbulence generating portions when the refrigerant passages 320 have the same sectional area.

As can be seen from FIG. 8, it is generally observed that refrigerant pressure drop is gradually increasing in proportion with the projected ratio.

However, heat radiation performance is not elevated further after the projected ratio exceeds a specific value.

It is seen that the projected ratio of the turbulence generating portions 320*c* ranges preferably from 0.1 to 0.43.

Further, the projected ratio most preferably ranges from 0.2 to 0.35.

Also, the above embodiment of the invention as shown in FIG. 4 may be designed to satisfy an equation L1+L2≧R1+R2, wherein L1 indicates the shortest length from the straight line connecting vertexes 'c' and 'd' of the turbulence generating portions 320*c* to the center 'a' of the upper circular passage 320*a*, and L2 indicates the shortest length from the straight line connecting the vertexes 'c' and 'd' of the turbulence generating portions 320*c* to the center 'b' of the lower circular passage 320*a*.

In addition to the embodiments of the invention as described hereinbefore, there is provided a heat exchanger tube as shown in FIG. 9 which includes a flat body 350 having specific lengths in longitudinal, vertical and lateral directions, respectively, and a number of refrigerant passages 320 which are extended through the body 350 along the longitudinal length and arrayed in plurality in the lateral direction, wherein each of the refrigerant passages 320 includes upper and lower circular passages 320*a*, which are formed in upper and lower sides of the body 350 in the vertical direction thereof with radii R1 and R2, respectively, a connecting passage 320*b* for connecting the upper and lower circular passages 320*a* in a communicating fashion and turbulence generating portions 320*c* which are projected from laterally opposed inside wall portions of the connecting passage 320*b* to have linear sections 320*e*.

In the upper and lower circular passages 320*a* connected with the turbulence generating portions 320*c* of the heat exchanger tube of the present invention as shown in FIG. 9, linear sections 320*d* may be provided in a lower portion of the upper circular passage 320*a* and an upper portion of the lower circular passage 320*a*.

Also, this embodiment of the invention may be designed to satisfy an equation L1+L2≧R1+R2, wherein L1 indicates the shortest length from the straight line connecting vertexes c and d of the turbulence generating portions 320*c* to the center a of the upper circular passage 320*a*, and L2 indicates the shortest length from the straight line connecting the vertexes c and d of the turbulence generating portions 320*c* to the center b of the lower circular passage 320*a*.

While the invention has been illustrated hereinbefore as each of the inner passages having two upper and lower circular passages 320*a*, at least three circular passages may be stacked over in the vertical direction of the tube body.

In addition, the outer passage configuration may be varied into a number of forms. For example, the outer passages may be provided in the form of circular passages. Alternatively, the refrigerant passages may consist of only the inner passages without the outer passages.

INDUSTRIAL APPLICABILITY

According to the present invention as described hereinbefore, the turbulence generating portions placed within each passage of the tube are rounded into curved configurations with predetermined curvatures so that they are hardly damaged or fractured during extrusion to improve machinability and product quality.

The present invention also connects the upper and lower circular passages in upper and lower sides of the tube body via the connecting passage having the turbulence generating portions so that more passages having a smaller hydraulic diameter can be formed in the tube of the same size without unnecessary waste of tube material.

Furthermore, the present invention arranges the turbulence generating portions in a lateral direction (Z-axial direction) of the tube body so that the passage is not filled with condensate films even though a large quantity of condensate is produced to reduce the thickness of the condensate films or break the condensate films to promote refrigerant to be converted into turbulent flow, thereby improving heat transfer ability.

What is claimed is:

1. A heat exchanger tube comprising:

a flat body having predetermined lengths in longitudinal, vertical and lateral directions, respectively; and a plurality of refrigerant passages formed through the body in the longitudinal direction and arranged in the lateral direction, wherein each of the refrigerant passages comprises:

upper and lower circular passages formed in upper and lower sides of the body in the vertical direction with predetermined radii R1 and R2, respectively;

a connecting passage for connecting the upper and lower circular passages in a communicating fashion; and turbulence generating portions projected from laterally opposed inside wall portions of the connecting passage with predetermined radii of curvature R3 and R4, respectively, wherein the turbulence generating portions have a projected ratio ranging from 0.1 to 0.43, wherein the projected ratio is obtained by dividing a projected length 'F' of the turbulence generating portions which is a distance between an outer common tangential line of the upper and lower circular passages and a tangential line of the turbulence generating portions parallel to the outer common tangential line with a maximum value 'E' of diameters of the upper and lower circular passages.

2. The heat exchanger tube according to claim 1, wherein the connecting passage further includes linear sections for connecting the turbulence generating portions with the upper and lower circular passages.

3. The heat exchanger tube according to claim 1, wherein the turbulence generating portions and the upper and lower circular passages satisfy an equation L1+L2 ≧R1+R2, wherein L1 indicates the shortest length from the straight line connecting vertexes c and d of the turbulence generating portions to the center a of the upper circular passage, and L2 indicates the shortest length from the straight line connecting the vertexes c and d of the turbulence generating portions to the center b of the lower circular passage.

* * * * *